US005434605A

United States Patent [19]

Osborne

[11] Patent Number: 5,434,605

[45] Date of Patent: Jul. 18, 1995

[54] AUTOMATIC FAILURE RECOVERY METHOD AND SYSTEM FOR INK-JET PRINTHEADS

[75] Inventor: William S. Osborne, Vancouver, Wash.

[73] Assignee: Hewlett-Packard Company, Palo Alto, Calif.

[21] Appl. No.: 949,318

[22] Filed: Sep. 21, 1992

[51] Int. Cl.[6] ..... B41J 2/165

[52] U.S. Cl. ..... 347/23

[58] Field of Search ..... 346/1.1, 75, 140 R; B41J 2/165; 347/23, 24, 30

[56] References Cited

U.S. PATENT DOCUMENTS

| | | | |
|---|---|---|---|
| 4,493,993 | 1/1985 | Kanamuller et al. | 346/140 R X |
| 4,853,717 | 8/1989 | Harmon et al. | 346/140 R |
| 4,959,662 | 9/1990 | Kobayashi | 346/1.1 |
| 4,959,673 | 9/1990 | Noda | 346/140 R |
| 5,086,305 | 2/1992 | Terasawa | 346/1.1 |
| 5,103,244 | 4/1992 | Gast et al. | 346/1.1 |
| 5,128,690 | 7/1992 | Nozawa | 346/1.1 |
| 5,166,708 | 11/1992 | Hirano et al. | 346/140 R |

FOREIGN PATENT DOCUMENTS

| | | | |
|---|---|---|---|
| 0424859 | 5/1991 | European Pat. Off. | B41J 2/165 |
| 447262 | 9/1991 | European Pat. Off. . | |

*Primary Examiner*—Benjamin R. Fuller
*Assistant Examiner*—Alrick Bobb

[57] ABSTRACT

A fully automatic failure recovery method and system are described. The method and system achieve selected priming and flushing of one of plural capped printheads in response to an ink drop detector that indicates the need therefor. The priming duration and pressure are adjustable in accordance with the automatically determined extent of the failure of the selected printhead reliably to fire ink droplets. In its preferred embodiment, the system uses a plural cam and cam follower valve subsystem that has few moving parts the cams of which selectively are rotated via a one-way clutch with the ink-jet printer's paper feed drive motor to open a selected vacuum tube leading to an ink accumulator. Preferably, the method includes capping the plural printheads, priming a selected one of them by vacuuming the selected tube to an adjustable pressure differential, during an adjustable delay flushing the same of ink and particulate drawn thereto into the accumulator, uncapping the printheads to terminate the priming and flushing, wiping the printheads and returning the printer to service. The recovery method and system features a relatively short cycle time.

11 Claims, 4 Drawing Sheets

AUTOMATIC FAILURE RECOVERY METHOD AND SYSTEM FOR INK-JET PRINTHEADS

BACKGROUND AND SUMMARY OF THE INVENTION

The present invention relates generally to failure recovery methods for ink-jet printheads that automatically recovers multiple printheads from an ink-clogged condition. More particularly, the invention concerns such a method and system that include automatically capping and selectively priming a printhead to draw dried ink or other contaminant therefrom in response to a detected failure condition of the printhead.

Ink-jet printhead nozzles commonly become plugged with wet or dry ink blobs or foreign matter, or become contaminated with internal bubbles that prevent them from operating properly. Lower print quality and user complaints often result. Even if the user discovers the problem, there often is nothing that can be done short of calling customer service. In a busy printer installation, such can be very costly, in lost opportunity due to excessive downtime, as well as in customer dissatisfaction.

Previously, single printhead systems have been proposed in an attempt to solve the problems of nozzle plugging or bubble formation therein. Typically, such systems require substantial operator intervention, and are not automatic. Further, they typically do not flush the vicinity of the printhead after priming, thereby leaving primed ink to accumulate-and ultimately to dry again and potentially to cause further clogging-near the printhead. Such conventional solutions do not lend themselves to multiple printhead systems.

Drop detectors have been proposed that are capable of detecting the presence of an ink droplet fired from an ink-jet printhead and any delay associated with its firing. One such drop detector, which is suitable for use with the invented automatic failure recovery method and system, is described in U.S. Pat. No. 5,109,239 entitled "Inter Pen Offset Determination and Compensation in Multi-Pen Ink Jet Printing Systems", which issued Apr. 28, 1992 and is subject to common ownership herewith. The drop detector described therein, which preferably is optical, produces a drop present signal indicative of the presence of an ink droplet traversing a detection window within an ink-jet printer. The drop detector is described as being capable also of measuring the time between a firing pulse that heats a thin-film resistor to fire a drop of ink toward a print medium. From such detection and measurement techniques, a failure condition such as a clogged or partially clogged nozzle of an ink-jet printhead may be detected.

A fully automatic failure recovery method and system are proposed that achieve selected priming and flushing of one of plural capped printheads in response to a detector that indicates the need therefor. The priming duration and pressure are adjustable in accordance with the automatically determined extent of the failure of the selected printhead reliably to fire ink droplets. In its preferred embodiment, the system uses a plural cam and cam follower subsystem that has few moving parts and that is selectively rotated via a one-way clutch with the ink-jet printer's paper feed drive motor. The recovery system cycle time is relatively short, thus minimizing printer downtime and maximizing quality print throughput.

These and additional objects and advantages of the present invention will be more readily understood after a consideration of the drawings and the detailed description of the preferred embodiment.

Figure 1:
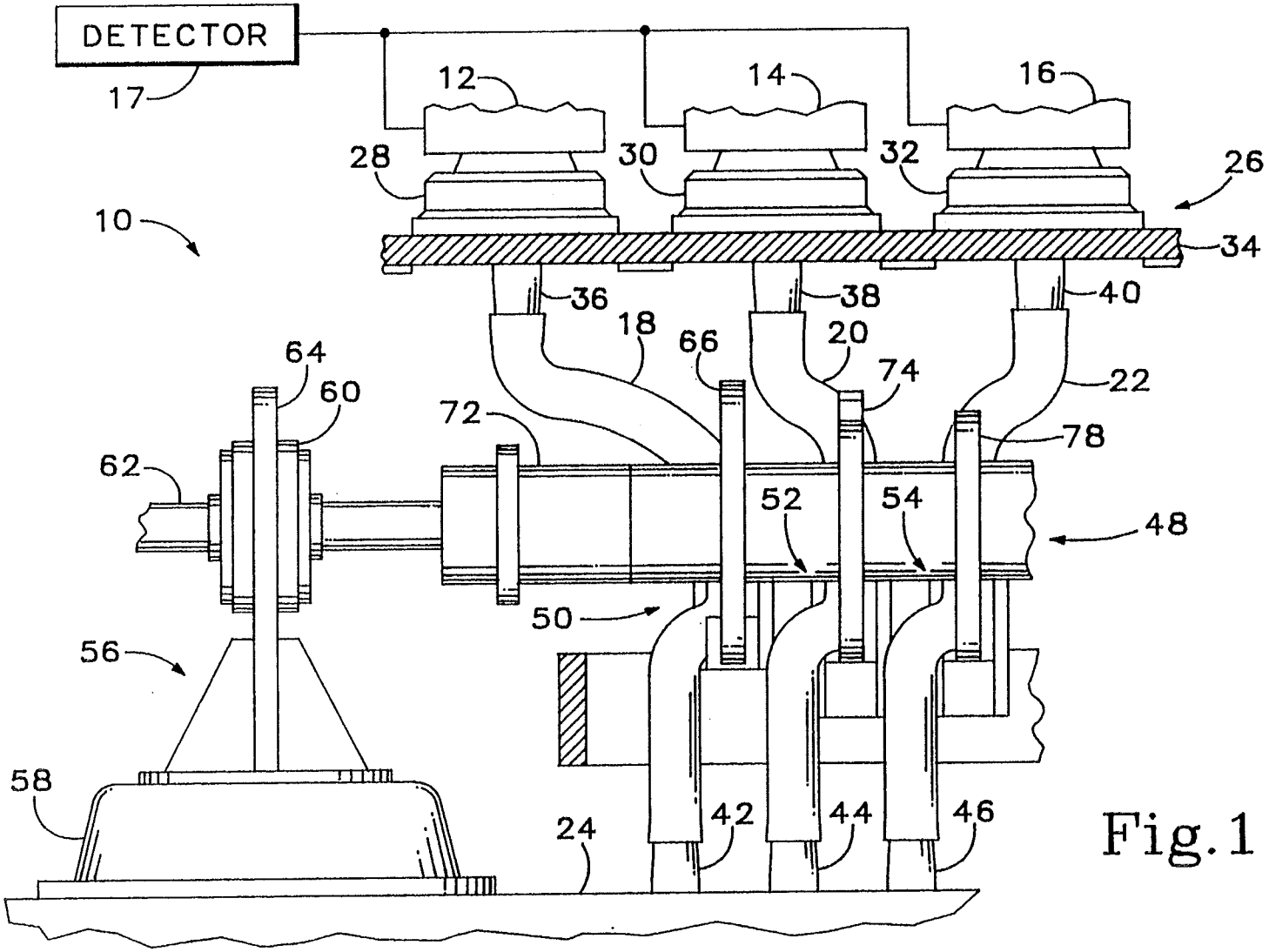
FIG. 1 is a front elevational, cut-away, fragmentary view of the failure recovery system made in accordance with the preferred embodiment of the invention.

DETAILED DESCRIPTION OF THE PREFERRED EMBODIMENTS AND BEST MODE OF CARRYING OUT THE INVENTION

FIGS. 1, 2A, 2B, 3A and 3B collectively show the invented automatic ink-jet printhead failure system, in various cutaway, fragmentary elevations, generally at 10. In its preferred embodiment, system 10 includes plural ink-jet printheads such as printheads 12, 14, 16, which employ a detector 17 such as that disclosed, for example, in U.S. Pat. No. 5,109,239. Sealingly associable with each printhead is a flexible vacuum tube such as tubes 18, 20, 22 which operatively connect the printheads with one or more ink accumulators such as accumulator 24. As may be seen, in the preferred embodiment of the invention, the printheads are sealingly associated with the flexible tubes via a sled assembly 26 that includes plural caps 28, 30, 32 covering upwardly extending peripheral bosses of associated cap mounts (not visible) mounted on a sled 34 having downwardly extending nozzles, 36, 38, 40 for connection with the upper ends of tubes 18, 20, 22. As may also be seen, accumulator 24 includes three upwardly extending nozzles 42, 44, 46 to which tubes 18, 20, 22, respectively, are connected on their lower ends.

It will be appreciated that sled assembly 26 provides for the sealing engagement of the printheads, while providing also for each of said printheads a through conduit extending from the upper reaches of the caps' lips to the lower reaches of the sled's nozzles. Such sled assembly 26 may be made in accordance with the teachings of my co-pending U.S. patent application Ser. No. 935,606 entitled "Ink-jet Printhead Cap Having Suspended Lip", which was filed Aug. 26, 1991 and which is commonly owned herewith. The disclosure of that co-pending patent application is incorporated herein by this reference.

System 10 also includes a valve subsystem 48 that includes, for each of the tubes, a tube pinch-off mechanism such as mechanisms 50, 52, 54 capable of selectively substantially enabling the flow of ink from the printheads into one or more accumulators such as accumulator 24. It will be appreciated that, in accordance with the preferred embodiment of the invention, the flow of ink is enabled by a given tube pinch-off mechanism only from a selected one of the printheads through a corresponding one of the tubes in response to a detected predefined failure condition of the selected printhead, e.g. ink clogging.

Finally, system 10 includes a pump 56 operable with tubes 18, 20, 22 and one or more accumulators such as accumulator 24 to produce a vacuum in the tube corresponding with the selected printhead to draw ink therefrom. It will be appreciated that the pump cooperates with the valve subsystem such that, upon detection of the predefined failure condition of a selected printhead, the printhead is primed, thereby recovering the printer from the printhead's ink-clogging failure condition. It has been determined to be insufficient simply to draw ink from the printhead through the sled assembly into the tube through which the flow of ink has been enabled. For this reason, it will be seen that pump 56 and valve subsystem 48 in accordance with the preferred embodiment of the invention are operable also to flush ink drawn into the tube from the selected printhead all the way through the tube and into one or more accumulators such as accumulator 24. Importantly, this invented feature prevents the accumulation of ink, which typically would dry, in tubes 18, 20, 22 and thus greatly extends the time period over which system 10 is effective in unassisted failure recovery.

Preferably, pump 56 is of the conventional diaphragm-type and is operable to evacuate accumulator 24 by oscillatory motion, of a diaphragm 58, produced by an eccentric cam 60 mounted on the ink-jet printers' paper feed drive shaft 62, with a pivotal, chassis-mounted pump arm 64 acting as a cam follower. It will be appreciated that details of pump 56 are within the; understanding of those skilled in the art. Importantly, however, pump 56 is operatively coupled with accumulator 24 (by a conduit not shown) and is capable of producing an approximately four pounds per square inch (4 psi) pressure differential at 14.7 psi ambient pressure. Preferably, accumulator 24 has an approximately 150 cubic centimeter (150 cc) capacity, and is, as suggested by FIGS. 1 through 3, formed as an integral part of the printer's chassis to which pump 56 is mounted.

Figure 2A:
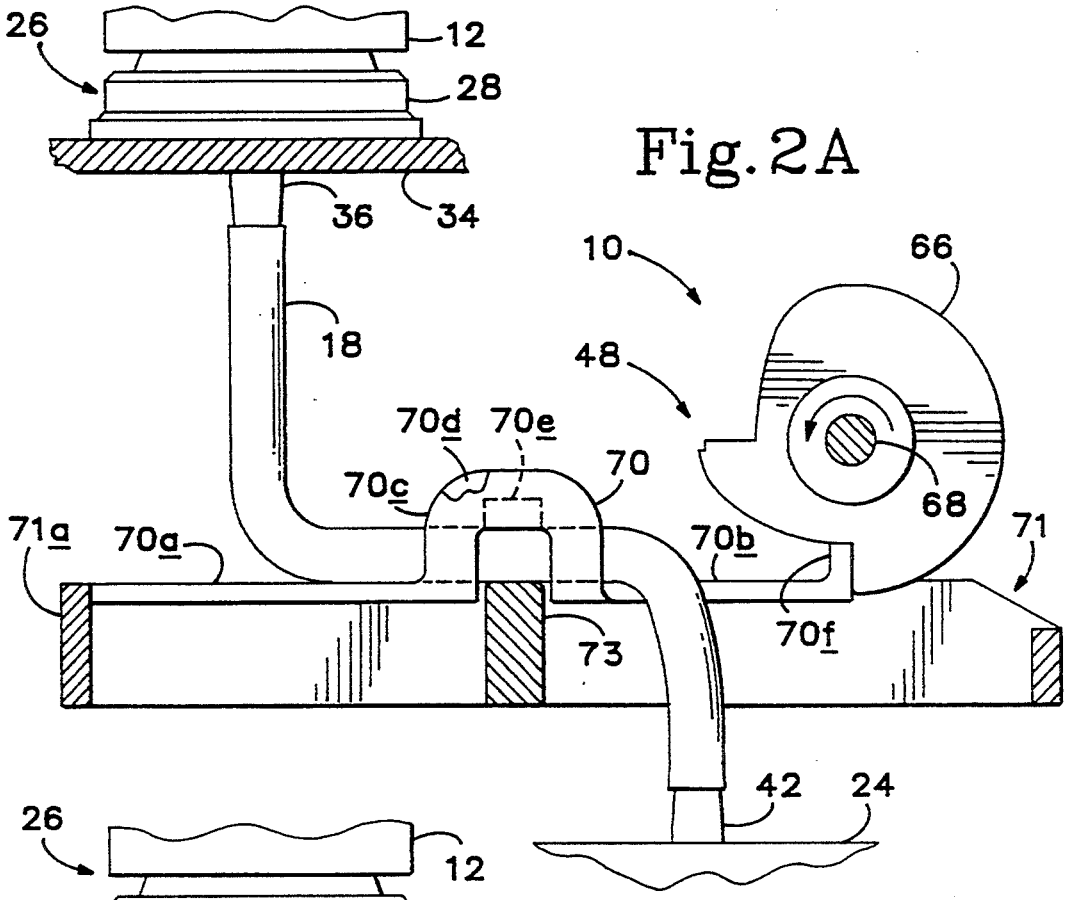
FIGS. 2A and 2B are a near side elevational, cut-away, fragmentary view of the system in various phases of its operation.
Figure 2B:
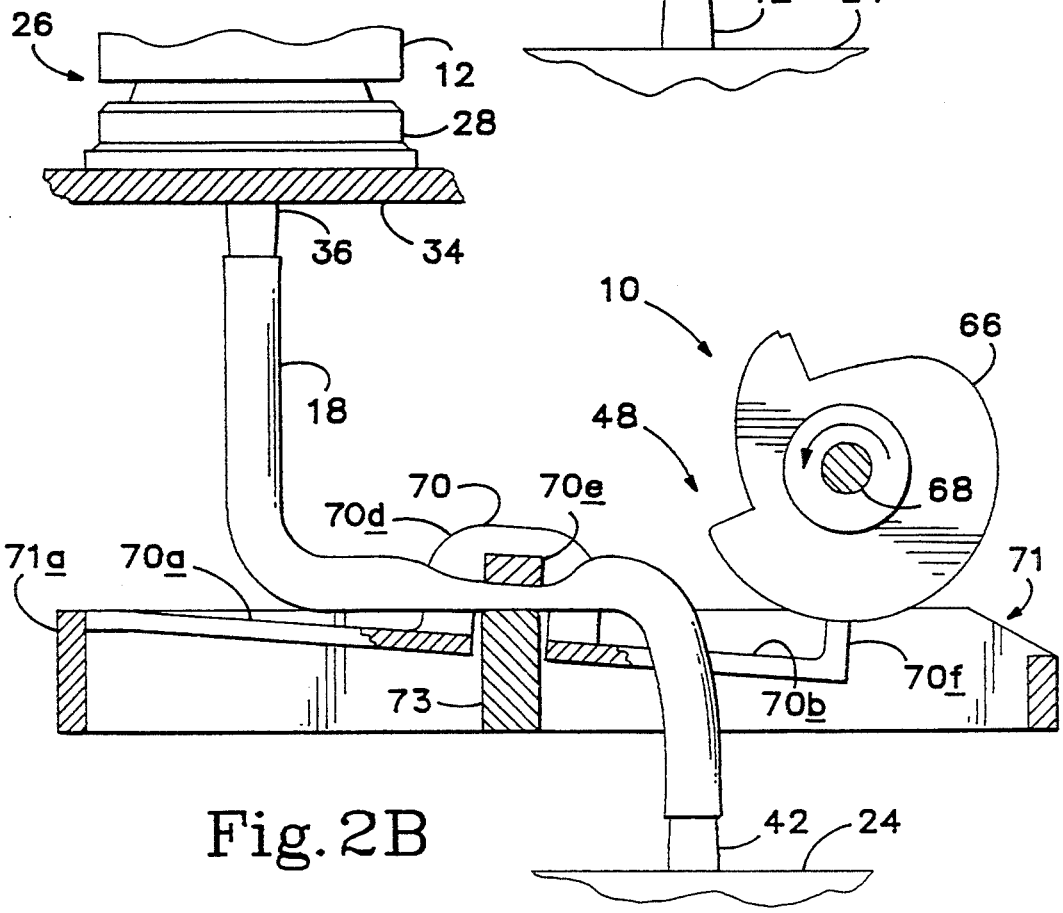

Referring now to FIGS. 1, 2A, 2B, 3A and 3C, each of said pinch-off mechanisms such as pinch-off mechanism 48 includes a cam such as cam 66 fixedly mounted on a rotatable drive shaft 68, and an associated follower member such as member 70 configured to impinge on a corresponding tube such as tube 18. Member 70 preferably has segmented planar expanses **70*a*, 70*b* connected by an inverted U-shaped archway formed by laterally, upwardly extending spans 70*c*, 70*d*. Extending between and connecting spans 70*c*, 70*d* is a laterally extending pinch-off arm (punch-off segment) 70*e* under which tube 18 is routed. Preferably, plural follower members such as member 70 are molded integrally to extend forwardly in cantilever fashion from a horizontal support member 71 that forms a part of a preferably unitary frame member 71 and are made of a resilient polymer. Each follower member such as follower member 70 also has a terminal free end 70*f* configured for following an associated cam such as cam 66 along its cam surface, which has a predefined profile substantially as shown in FIGS. 2A and 2B**.

It will be appreciated that frame member 71 preferably is mounted for lateral movement relative to the cams such as cam 66 (e.g. on a movable carriage not shown), such that the follower members such as follower member 70 remain, while the printer is in operation, in idle positions between adjacent cams. In this way, the follower members are not always engaged with the cams, but rather are selectively engageable therewith only when the sled assembly and printhead carriage are in their service positions relative to the cams.

Each cam such as cam 66 is selectively rotatable in the counterclockwise (CCW) direction shown in FIGS. 2A, 2B, 3A and 3B (which will be referred to herein as backward) by a common drive motor that rotates the ink-jet printer's paper feed drive shaft 62. Interposing drive shaft 62 and drive shaft 68 is a one-way clutch 72 (refer to FIG. 1) coupling the drive motor with drive shaft 68 for the uni-directional (backward) rotation of the cams. As will be seen by reference to FIG. 4, selective, backward rotation of the cams such as cam 66 with drive shaft 62 enables valve subsystem 48 to pinch off, thus to sealingly close, tubes 18, 20, 22 and yet selectively to enable the flow of ink through a selected one of them to prime and flush a selected printhead. Those of skill in the art will appreciate that clutch 72 is conventional, and may take the form of a wire-form slip clutch element (such as a wound spring which offers differential torque when coiled and uncoiled) as is known in the arts. From FIGS. 3A and 3B, it may be seen that the tubes such as tubes 18, 20 are pinched off by relative movement (pinch-off segments) between pinch-off arms such as arms **70*e*, 76*e* and one or more upwardly extending bosses (opposing pinch-off segments) such as boss 73** formed in the printer's chassis.

Those skilled in the art will appreciate that cam shaft 68 may, in an alternative but also preferred embodiment, be one and the same with drive shaft 62, with the cam collars shown in the drawings selectively rotating the cams thereabout when clutch 72 is engaged. Those skilled in the art also will appreciate that the positional order (i.e. left to right in FIG. 1) of the various cams, e.g. illustrated cams 66, 74, 78, along shaft 68 is unimportant, as any order straightforwardly is accommodated to select a printhead for priming and flushing through an associated tube by the preferred method of the invention to be described by reference to FIG. 4.

Returning briefly to FIGS. 3A and 3B, it is seen that a cam 74 having a predefined profile that is similar to that of cam 66 also is fixed on drive shaft 68 for rotation therewith. Importantly, cam 74 is different from cam 66 in the position around its periphery of what will be referred to herein as its notched step. Each of the cams (the number of which equals the number of printheads) within valve subsystem 48 is fixed in a predefined angular orientation about the axis of cam shaft 68 (or may be integrally molded with one another and therewith, within the spirit of the invention) with its tube-opening operative (notched) step disposed at radial angles thereabout which are separated by approximately 67°. (Skilled persons will appreciate that the notch immediately adjacent the step represents a closed condition of the associated tube, with a terminal end of a follower member, e.g. end **70*f* of member 70, impinging therein to prevent even slight forward rotation of the cam (clockwise in FIGS. 2A, 2B, 3A, 3B**) that might inadvertently cause the closed tube to open).

Each of the cams has a second, typically un-notched step that is aligned with every other such second step at what will be referred to herein as a start, or index, position. One of the cams not shown will be understood to have only a single step that serves as both a start, or index, position of that cam and also a tube-opening operative step. Those of skill will appreciate that each cam may have complementary, aligned notches in its periphery corresponding with the notched steps of each other cam, thereby to increase the robustness and security of a forward rotation-preventive mechanism to be described below.

Figure 3A:
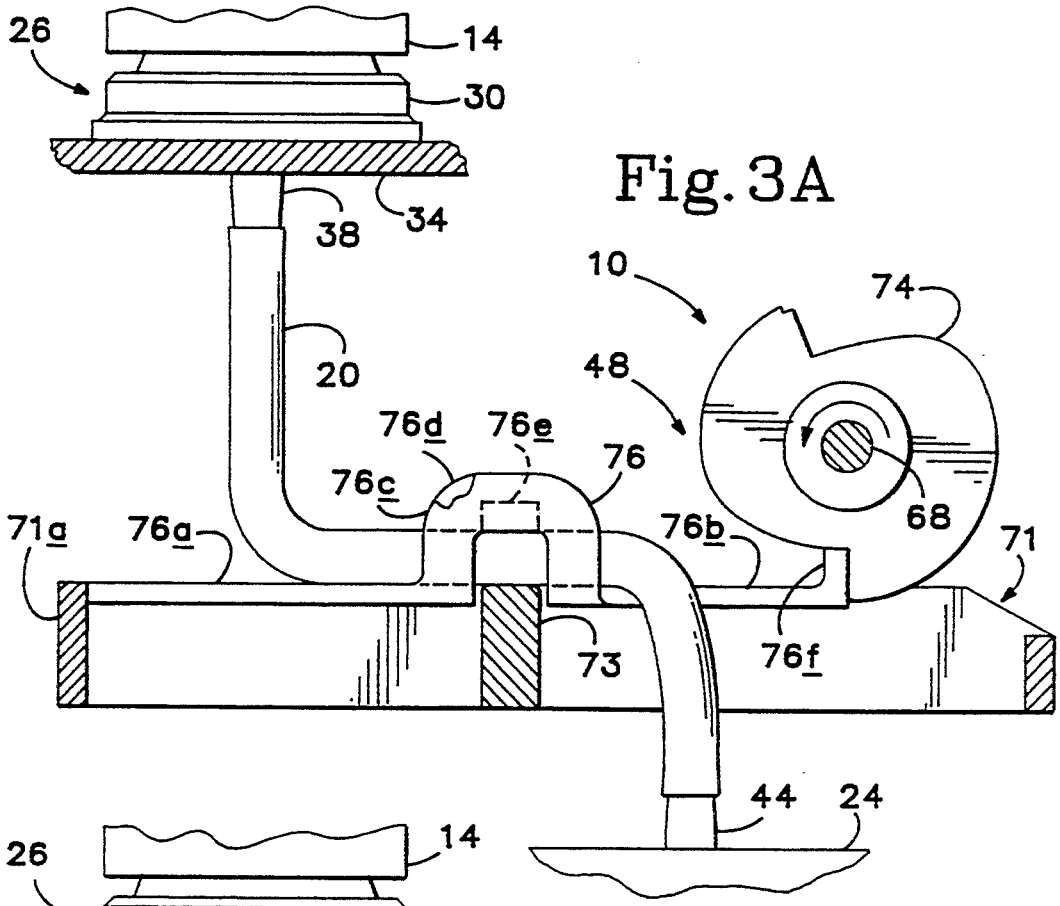
FIGS. 3A and 3B are a far side elevational, cut-away, fragmentary view of the system in various phases of its operation.
Figure 3B:
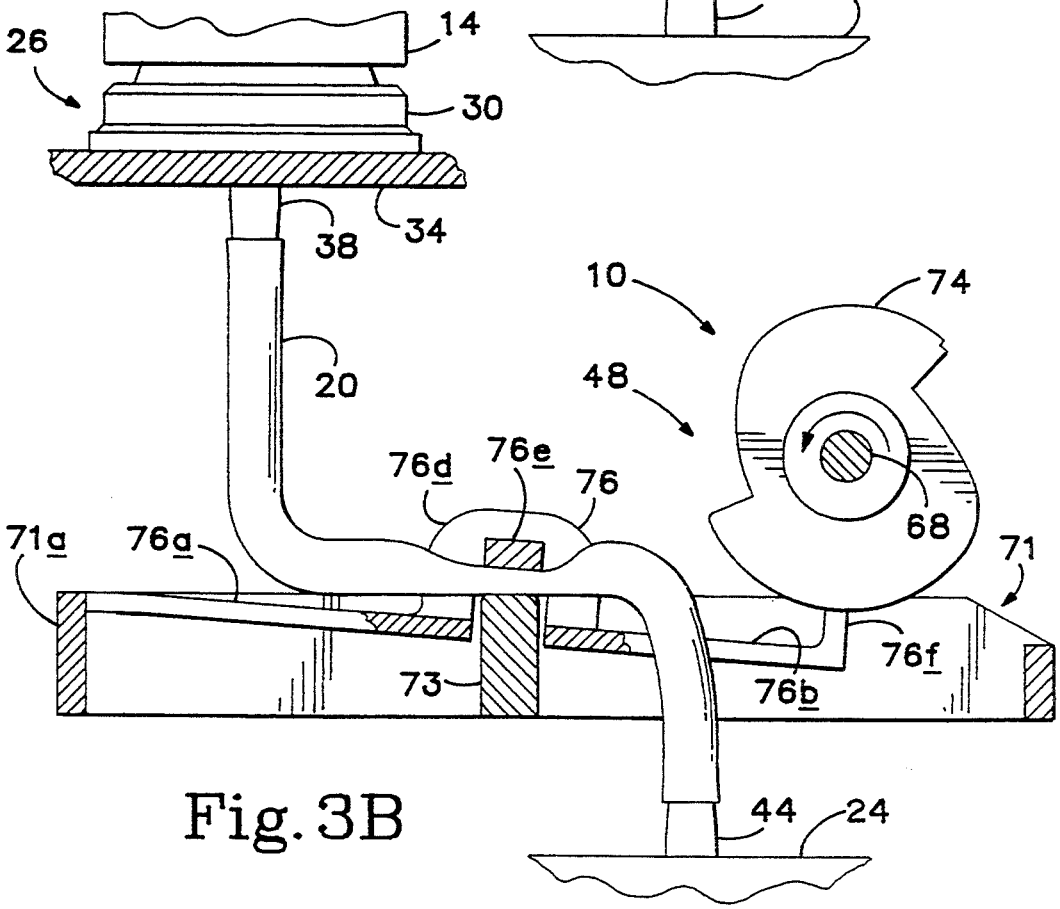

Such angularly positioned notched steps in cams such as cams 66, 74 provide the necessary phasing, or timing, relationship between the movement of corresponding follower members engaged therewith to provide for the independent, pinch-off control of each of tubes 18, 20, 22. FIG. 2A shows follower member 70 in a start position of non-impingement on tube 18 whereby ink may be drawn through tube 18 into accumulator 24 from printhead 12, and FIG. 3A shows a follower member 76 in a start position of nonimpingement on tube 20 whereby ink may be drawn through tube 20 into accumulator 24 from printhead 14. FIG. 2B shows follower member 70 in pinch-off impingement on tube 18, thereby preventing the flow of ink from printhead 12 into accumulator 24, and FIG. 3B shows follower member 76 in pinch-off impingement on tube 20, thereby preventing the flow of ink from printhead 14 into accumulator 24.

It will be appreciated that each successive cam such as cam 78 (refer to FIG. 1) is fixed for rotation on shaft 68 at an identical predefined angle relative to cams 66, 74, but with its notched step located thereon at a clockwise angle relative to that of cam 74 of approximately 67°, in accordance with the preferred embodiment of the invention in which the total number of cams within valve subsystem 48 is four.

It will be understood (by reference to FIG. 2A, viewing the peripheral surface of cam 66 as a clock face and proceeding in a clockwise direction therearound) that the predefined profile of cam 66 provides first for a fully opened condition (the un-notched step) of associated tube 18 (at 6 o'clock), then a gradually and fully closing condition (at 9 o'clock) followed immediately by an abruptly fully opened condition (the notched step), then a gradually and fully closing condition that results in relatively long-term associated tube 18 closure (from approximately 12 o'clock to 5:29 o'clock). By similar reference to FIG. 3A, it will be understood that the predefined profile of cam 74 provides first for a fully opened condition (the un-notched step) of associated tube 20 (at 6 o'clock), then a gradually and fully closing condition (at approximately 11 o'clock) followed immediately by an abruptly fully opened condition (the notched step), then a gradually and fully closing condition that results in relatively long-term associated tube closure (from approximately 2 o'clock to 5:29 o'clock).

The notch immediately adjacent the tube-opening operative step on each cam is for engaging a corresponding follower member such as member 70 to prevent forward rotation of drive shaft 68 that might result from a slight torque (associated, for example, with uncoiling the spring) developed by clutch 72 during forward rotation of drive shaft 62. The reason for providing for two tube openings and closures per rotation for selectively illustrated cams 66, 74 immediately will become clear.

Figure 4:
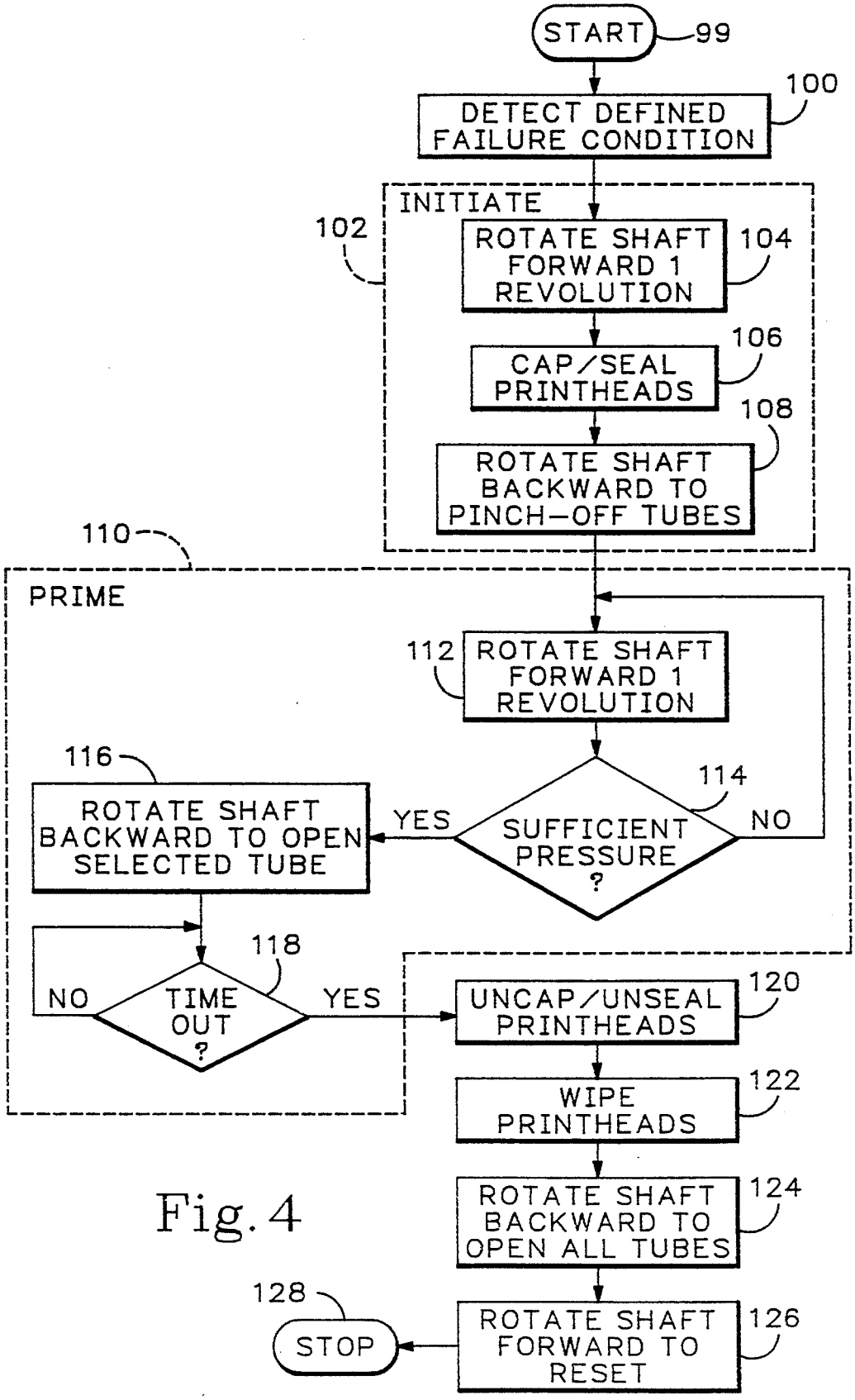
FIG. 4 is a flowchart that illustrates the preferred method of the invention.

Turning to FIG. 4, the preferred method of the invention will be described by reference to a flowchart. The failure recovery method starts at 99 with the detection of a defined failure condition 100 of an ink-jet printhead (relating to the printhead's ability reliably to eject or fire ink droplets therefrom). During an initiation phase 102 of the failure recovery method, at 104 drive shaft 62 is rotated forward (in a clockwise direction opposite that indicated by the arrow in FIGS. 2 and 3) one revolution. During such forward rotation of shaft 62, clutch 72 develops a slight torque in shaft 68 that causes rotation of the cams (into their start position shown in FIGS. 3A and 3B) against a mechanical stop (not shown) associated with the printer's chassis of any conventional design, after which clutch 72 slips. It will be appreciated that, during such forward rotation, the cams are not engaged by their associated follower members, as member 71 mounting the latter is shifted laterally such that the members are in an idle position between the cams.

At 106 a carriage (not shown) mounting printheads 12, 14, 16 is moved into a service position to cap and seal the printheads against the lips of caps 28, 30, 32. At the same time, frame 71 is moved into its operative, service position in which the follower members mounted thereon assume the positions shown in FIGS. 1, 2A and 3A. At 108 drive shaft 62 and coupled cam shaft 68 are rotated backward to a pump position in which all tubes such as tubes 18, 20, 22 are pinched off or closed. Those skilled in the an will appreciate that this pump position of the cams is not shown in FIGS. 2A, 2B, 3A or 3B, but represents aligned positions along the substantially circular arcs of the cams in which all follower members are forced downwardly to impinge on, thus to pinch-off, all associated tubes.

The-method includes priming a selected printhead to draw ink therefrom. Priming first involves rotating drive shaft 62 forward an integer number of revolutions at 112, 114 until it is determined, e.g. by a microprocessor controlling the rotation of the paper feed drive motor, that sufficient pressure differential (vacuum) has been developed via pump 56 to prime the printhead, based upon the extent of the clogging that has been detected. When it is determined at 114 that a sufficient pressure differential (vacuum) has been developed in accumulator 24 and in the pinched-off lower extremity of the tubes, drive shaft 62 and shaft 68 are rotated backward at 116 a predetermined amount (corresponding to the angular orientation of the associated cam's operative, tube-opening (notched) step) to a position in which a selected tube is open. After a programmable timeout has expired, as determined at 118, priming is terminated at 120 by uncapping, and thus unsealing, printheads 12, 14, 16. It will be appreciated that uncapping and unsealing the printheads causes the selected printhead, the associated tube of which is open, forcefully to eject wet and dry ink and other particulate through sled assembly 26 into the associated, open tube wherein the vacuum is sufficiently high, e.g. approximately 4 psi, to flush such ink and particulate entirely through the open tube and into one or more accumulators such as accumulator 24.

Preferably, after uncapping and unsealing the printheads, all printheads conventionally are wiped at 122 and drive shaft 62 and coupled cam shaft 68 are rotated backward at 124 to open all tubes. At 126 drive shaft 62 is rotated at low torque forward to the mechanical stop to reset valve subsystem 48, thereby to stop the failure recovery cycle at 128.

It will be appreciated that a single printhead or plural printheads mounted on a movable carriage, after being primed as described above, preferably may be returned from the service position shown in FIGS. 1 through 3B of capping and sealing engagement with sled assembly 26 to a printing position in which printing may resume. As illustrated in FIG. 4, and with as many as twenty forward revolutions at 112, 114, the entire failure recovery cycle time still is less than 20 seconds in duration. Importantly, failure recovery requires no operator intervention. Thus, a printhead's failure condition is detected and automatically recovered from under the programmable control of a microprocessor that also typically would control also other printer operations.

It will be appreciated that, by priming only a selected printhead, and by flushing ink and particulate primed therefrom from the vicinity of the selected printhead, relatively smaller vacuum pressures need be produced by pump 56, resulting in overall weight, complexity and cost reduction. Yet, upon the detection of a defined failure condition of any one of the plural printheads in the an ink-jet printer, the invented recovery system enables recovery from even a seriously clogged one or more of such plural printheads. Simply stated, if more than one printhead is seen to have a failure condition, then valve subsystem 48 is activated multiple times in some defined succession, first to unclog one printhead and then the other.

It may be seen from FIG. 4 at 110 that both the pressure differential (vacuum) and duration or timing of the priming cycle are controllable by the microprocessor. The former is indicated at 112, 114 in FIG. 4 by the fact that the number of forward revolutions through which drive shaft 62 is driven to actuate pump 56 is programmable, thus establishing a pressure criterion which may be based upon the extent of a detected, defined failure condition of the printhead. For example, a slight clogging that is detected by the drop detector might require only 1 or 2 psi vacuum in the tube associated with the failed printhead, in which case no more time than is necessary in rotating drive shaft 62 and actuating pump 56 will be consumed in developing a vacuum in the associated tube. The latter is indicated by the fact that the time during which such vacuum is applied to the nozzles of the failed printhead is determined by a variable time-out at 118 that also is under microprocessor control. This programmable time-out can be relatively brief or extended, depending upon the microprocessor's determination of the time during which such determined vacuum need be applied to the printhead adequately to prime the printhead and flush its associated tube.

INDUSTRIAL APPLICABILITY

It may be seen then that the invented failure recovery system for ink-jet printers enables the selective priming of the printhead, followed by the flushing from the vicinity thereof, of ink and particulate that has been determined, e.g. by a drop detector, to be clogging the printhead's nozzles. The system and method that are described herein are fully automatic, requiting no operator intervention and taking the printer off-line, or into its service mode, for a relatively short period of time, e.g. less than twenty seconds. The printer is returned to service in a restored condition that extends its useful life and that ensures continued high print quality, yet without a field service or maintenance call. The invented method and system are implemented in relatively few, low-cost components that utilize the printer's existing drive motor to produce failure recovery that is reliable and cost effective.

While the present invention has been shown and described with reference to the foregoing operational principals and preferred embodiment, it will be apparent to those skilled in the art that other changes in form and detail may be made therein without departing from the spirit and scope of the invention as defined in the appended claims.

I claim:

1. An automatic ink-jet printhead failure recovery method for use with an ink-jet printer having plural printheads and corresponding plural caps, the method comprising the steps of:

detecting a defined failure condition of a selected one of such printheads that relates to an ability of said selected one of such printheads to reliably eject ink droplets;

determining an extent of the defined failure condition;

in response to said detecting, moving said selected one of such printheads into a service position of sealing engagement against a corresponding one of such caps;

priming said selected one of such printheads to draw ink therefrom into said corresponding one of such caps;

setting automatically a vacuum level for said priming in accordance with a pressure criterion that automatically is determined in response to said detecting step and based upon said determining step; and returning said selected one of such printheads from said service position to a printing position.

2. The method of claim 1 which further comprises after said priming step and before said returning step, flushing ink drawn into the corresponding one of said caps from the selected one of said plural printheads into an accumulator.

3. The method of claim 1, wherein said priming step is performed on at least two selected ones of such plural printheads prior to said returning step.

4. The method of claim 2 in which the ink-jet printer has plural printheads, wherein said priming is performed selectively on one or more of such plural printheads.

5. The method of claim 1 which further comprises capping said selected one of said plural printheads prior to said priming step and uncapping said selected one of said plural printheads to terminate said priming.

6. The method of claim 5 which further comprises wiping said selected one of said plural printheads after said priming step.

7. An automatic ink-jet printhead failure recovery system comprising:

plural ink-jet printheads, a plurality of flexible tubes, each of said tubes being sealingly associable with each of said printheads and operatively connecting each of said printheads with one or more ink accumulators;

means for detecting a predefined failure condition of a selected one of said printheads;

a valve subsystem including for each of said tubes, a tube pinch-off mechanism capable of normally disabling and selectively enabling a flow of ink into said one or more accumulators from said selected one of said printheads through a corresponding one of said robes, said valve subsystem being responsive to said means for detecting; and a pump operably coupled with each of said tubes and said one or more accumulators to produce a vacuum in said corresponding one of said tubes to draw ink from said selected one of said printheads, to thereby prime said selected one of said printheads.

8. The system of claim 7, wherein said pump and said valve subsystem are operable to flush ink drawn from said printheads into said one or more accumulators.

9. An automatic ink-jet printhead failure recovery system for an ink jet printer comprising:

plural ink-jet printheads, a plurality of flexible tubes, each of said tubes being sealingly associable with each of said printheads and operatively connecting each of said printheads with one or more ink accumulators;

means for detecting a predefined failure condition of a selected one of said printheads;

valve subsystem including for each of said tubes, a tube pinch-off mechanism capable of normally disabling and selectively enabling the flow of ink into said one or more accumulators from said selected one of said printheads through a corresponding one of said tubes, said valve subsystem being responsive to said means for detecting, wherein said pinch-off mechanism includes a cam having an associated follower member including two opposing pinch-off segments, for impinging on said corresponding one of said tubes, wherein Said corresponding one of said tubes is interposed between said pinch-off segments, and said pinch-off segments move relative to each other, said cam being selectively rotatable by a drive motor; and a pump operably coupled with said tubes and said one or more accumulators to produce a vacuum in said corresponding one of said tubes to draw ink from said selected one of said printheads, thereby to prime said selected one of said printheads.

10. The system of claim 9 wherein an ink jet printer is provided having a paper feed drive shaft, said drive motor and said drive shaft being coupled together by a one-way clutch for substantially unidirectional rotation therewith.

11. The system of claim 10, wherein said follower member is selectively engageable with cam.

* * * * *